US006308641B1

(12) United States Patent
Kingbury

(10) Patent No.: US 6,308,641 B1
(45) Date of Patent: Oct. 30, 2001

(54) STOWABLE READING TRAY

(76) Inventor: Brian F. Kingbury, 13005 S. McVickers, Palos Heights, IL (US) 60463

( * ) Notice: Subject to any disclaimer, the term of this patent is extended or adjusted under 35 U.S.C. 154(b) by 0 days.

(21) Appl. No.: 09/567,793

(22) Filed: May 9, 2000

Related U.S. Application Data

(60) Provisional application No. 60/133,353, filed on May 10, 1999.

(51) Int. Cl.[7] ..... B47B 5/00
(52) U.S. Cl. ..... 108/42
(58) Field of Search ..... 108/42, 47, 48, 108/33, 35, 40, 39, 108

(56) References Cited

U.S. PATENT DOCUMENTS

| | | | | |
|---|---|---|---|---|
| 1,809,866 | * | 6/1931 | Riesche | 108/40 X |
| 3,226,776 | | 1/1966 | Van Wormer . | |
| 4,263,854 | * | 4/1981 | Moore et al. | 108/40 X |
| 4,803,930 | | 2/1989 | Corcoli . | |
| 5,081,724 | | 1/1992 | Takahashi et al. . | |
| 5,487,342 | | 1/1996 | Mack . | |
| 5,513,574 | | 5/1996 | Collins . | |
| 5,588,697 | * | 12/1996 | Yoshida et al. | 108/47 X |
| 5,713,404 | | 2/1998 | Ladewig . | |
| 5,775,655 | | 7/1998 | Schmeets . | |
| 6,161,486 | * | 12/2000 | Boots | 108/33 X |

FOREIGN PATENT DOCUMENTS

| | | | | |
|---|---|---|---|---|
| 411660-A | * | 1/1993 | (DE) | 108/47 |
| 1264691 | * | 5/1961 | (FR) | 108/33 |

* cited by examiner

*Primary Examiner*—Jose V. Chen
(74) *Attorney, Agent, or Firm*—Gary M. Hartman; Domenica N. S. Hartman

(57) ABSTRACT

A wall-mounted stowable reading tray assembly (10) suitable for placement in a bathroom or any other confined space. The tray assembly (10) has a tray (12) configured to require minimal room and wall space when stowed, yet provides ample surface area for supporting reading materials when deployed. The tray assembly (10) is legless, and therefore the tray (12) is cantilevered from its mounting wall when deployed. The tray (12) is stowed within a mounting frame (14) attached to the mounting wall, and recessed into the wall if so desired. The tray assembly (10) preferably employs means (38) for supporting the tray (12) when deployed, and which is also stowed with the tray (12). The tray (12) includes an extension (44) that can be stowed within the tray (12) when not needed. Consequently, the extension (44) does not occupy any additional room or wall space when the tray (12) is stowed.

20 Claims, 4 Drawing Sheets

STOWABLE READING TRAY

CROSS REFERENCE TO RELATED APPLICATIONS

This application claims the benefit of U.S. Provisional Application No. 60/133,353, filed May 10, 1999.

BACKGROUND OF THE INVENTION

1. Field of the Inveniton

The present invention generally relates to wall-mounted support structures, including tables and trays. More particularly, this invention relates to a wall-mounted tray that is configured to require minimal room and wall space when stowed, yet provides ample surface area for supporting reading materials.

2. Description of the Prior Art

Various wall-mounted tables, trays and other support structures have been proposed in the past. Most wall-mounted tables are designed to be stowed by folding the table either up or down to be generally parallel to their mounting walls, as shown in U.S. Pat. Nos. 4,803,930 to Crocoli, 5,081,724 to Takahashi et al., 5,487,342 to Mack, 5,513,574 to Collins, 5,713,404 to Ladewig, and 5,775,655 to Schmeets. Prior art tables of the type exemplified by Crocoli and Collins have employed folding legs that support the extreme edge of the table from the floor. Other stowable tables of the prior art have employed brackets or cylinders to support the table from its mounting wall, as shown in Takahashi et al., Mack, Ladewig and Schmeets. To increase the distance that the table can project from its mounting wall, tables have been mounted to sliding rails as done in Crocoli. To maximize surface area, tables have been configured with folding leaves as done in Crocoli, Mack and Collins.

With each of these types of tables, in order to minimize the wall space occupied by the table when stowed, special accommodations must be provided in order to stow the legs or support brackets. As a result, wall-mounted stowable tables can be difficult to recess into the walls of many building structures, but will project an undesirable distance into a room if not recessed. These shortcomings are more acute if the table is desired to be mounted in a very small room, as would be the case of desired as a reading table in a bathroom, and particularly bathrooms of the size often found in hotels, motels, airplanes and buses. Another shortcoming of prior art wall-mounted tables is that the steps required to deploy and stow them can at times be relatively cumbersome or complicated. Legs that support the outer edge of the table from the floor (e.g., Crocoli and Collins) are often not practical, while support brackets mounted to the wall can significantly limit leg room beneath the table if they support the table from beneath (e.g., Mack, Ladewig and Schmeets), and significantly limit the support surface area readily available to the user if they support the table from above (e.g., Takahashi et al.).

SUMMARY OF THE INVENTION

According to the present invention, there is provided a wall-mounted stowable reading tray suitable for placement in a bathroom or any other confined space. The tray is configured to require minimal room and wall space when stowed, yet provides ample surface area for supporting reading materials when deployed. The tray of this invention is legless, and therefore may be cantilevered from its mounting wall when deployed. The tray is stowed within a mounting frame attached to the mounting wall, and recessed into the wall if so desired. The tray preferably employs means for supporting the cantilevered tray, and which can be readily stowed with the tray within the mounting frame. In one embodiment, a pair of cords or folding brackets supports the tray from above, while in a second embodiment the tray is equipped with a single bracket that supports the tray from beneath, so as not to interfere with the use of the tray. The bracket of the second embodiment is configured to fold up flush and tight with the tray in the mounting frame, and therefore does not significantly add to the room and wall space occupied by the tray either when deployed or stowed. The tray further includes an extension that can be stowed within the tray when not needed. Consequently, the extension does not occupy any additional room or wall space when the tray is stowed.

Other features of the tray include a latch for locking the tray in its stowed position within the mounting frame. The latch is configured to be substantially flush with the mounting frame, and therefore does not contribute to the space occupied by the tray when either stowed or deployed. Another notable feature of this invention is the ample surface area of the tray that is uncluttered by the mechanical components of the tray. For use in commercial settings such as hotels, motels, airplanes and buses, the tray and its mounting frame are preferably equipped with compartments in which advertising can be contained. For example, advertising can be inserted to be viewed on both surfaces of the tray and a portion surface of the mounting frame. The tray is preferably equipped with transparent panels on both of its surface, forming slots in which advertising can be easily installed and removed.

Other objects and advantages of this invention will be better appreciated from the following detailed description.

BRIEF DESCRIPTION OF THE DRAWINGS

The present invention will now be described, by way of example, with reference to the accompanying drawings, in which.

DETAILED DESCRIPTION OF THE PREFERRED EMBODIMENT

Two embodiments of a wall-mounted stowable reading tray are shown in the Figures in accordance with this invention. The embodiments differ from each other primarily by the use of different types of support brackets.

Figure 1:
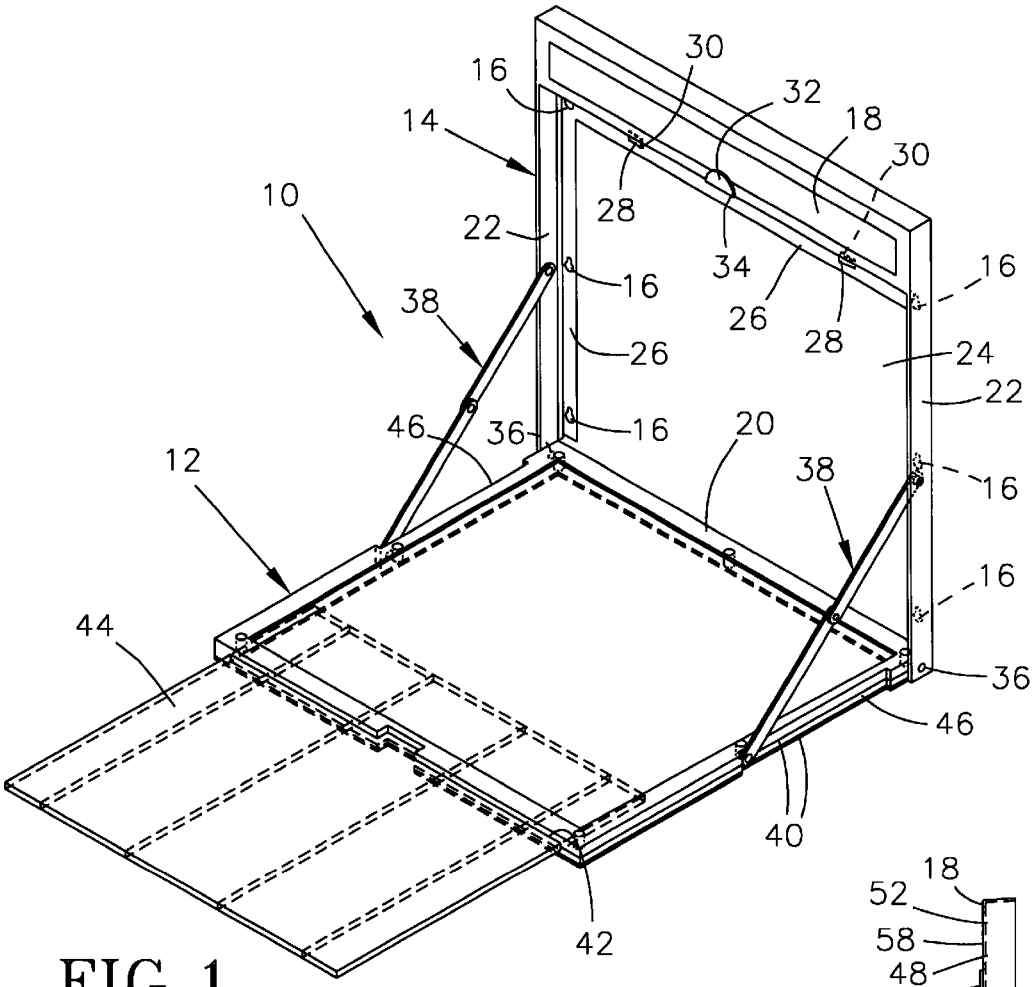
FIG. 1 is a perspective view of a reading tray and mounting frame assembly in accordance with a first embodiment of this invention.
Figure 2:
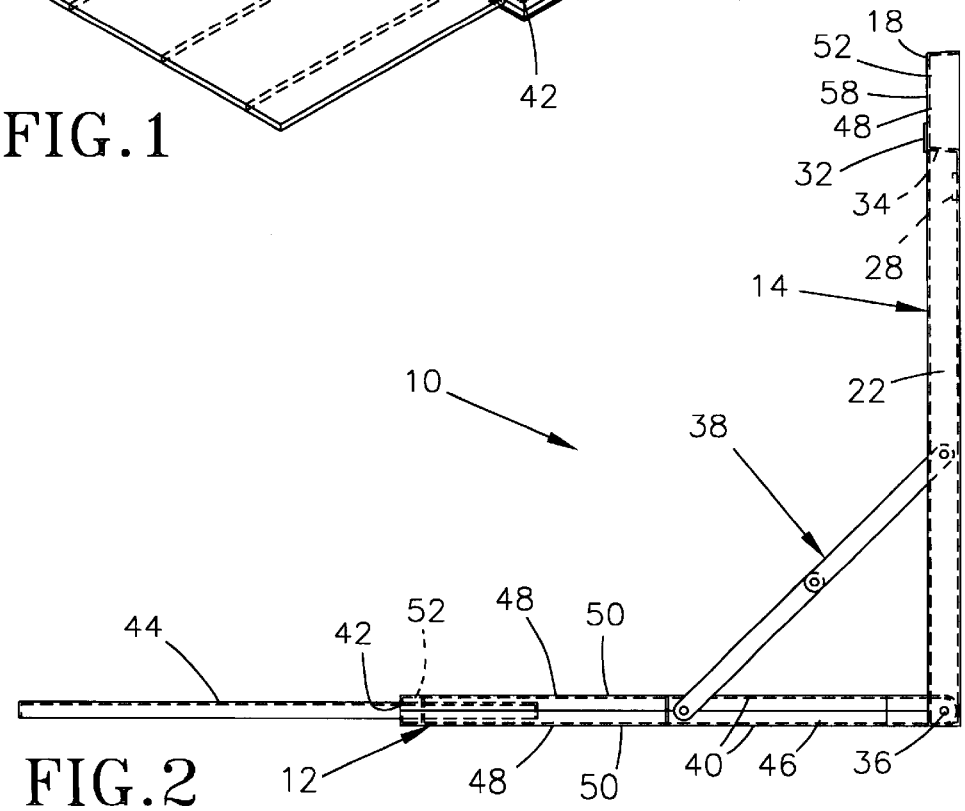
FIG. 2 is a side view of the assembly of FIG. 1.
Figure 3:
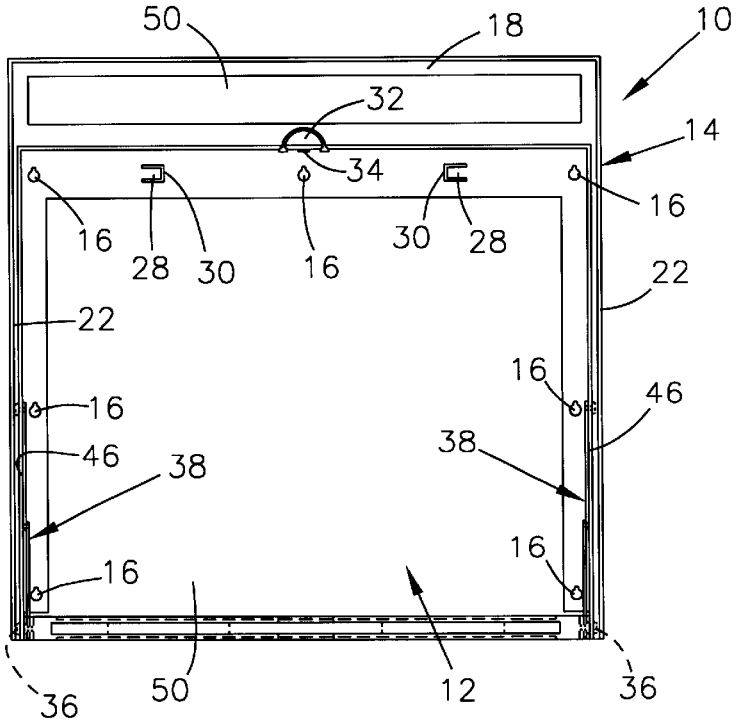
FIG. 3 is a frontal view showing the tray of FIG. 1 stowed in its mounting frame.

With reference to FIGS. 1 through 3, an assembly 10 is shown to include a tray 12 and mounting frame 14. Suitable materials for the tray 12 and frame 14 include various structural plastics, though it is foreseeable that other materials could be used. The mounting frame 14 is equipped with slotted screw holes 16 to enable the frame 14 to be mounted to a wall (not shown) and, if so desired, mounted within a recess in a wall. The frame 14 has a generally rectangular shape, though other shapes are possible. The frame 14 is Generally composed of an upper casing 18, lower rail 20, and side rails 22, which together define a recess 24 within the frame 14 that is sized to receive the tray 12 when stowed. The slotted screw holes 16 are located in a flange 26 that extends along the casing 18 and side rails 22. Preferably, the tray 12 is flush with the casing and rails 18, 20 and 22 when stowed within the recess 24.

A pair of tray springs 28 are disposed on the flange 26 adjacent the upper casing 18. Each spring 28 is delineated from the flange 26 by a generally U-shaped slot 30, and arcuately projects outward from the flange 26 so as to be cantilevered. As a result, when the tray 12 is stowed in the recess 24, the springs 28 are deflected toward a flatter shape, i.e., more flush with the flange 26, and therefore biases the tray 12 away from the flange 26 and the stowed position within the recess 24. The tray 12 is retained in the recess 24 by a push button latch 32 located adjacent the upper casing 18. The latch 32 is also cantilevered from the flange 26, and is equipped with a small protrusion 34 that engages the edge of the tray 12 when the tray 12 is stowed. As seen from the Figures, the latch 32 is configured to be substantially flush with the frame 14, and therefore does not contribute to the space occupied by the tray 12 when either stowed or deployed.

The tray 12 of FIGS. 1 through 3 is mounted to the lower rail 20 of the frame 14 by a pair of pivot assemblies 36 and a pair of folding brackets 38. The brackets 38 are mounted within a recess 46 formed in each side of the tray 12, so that the brackets 38 are stowed between the tray 12 and the side rails 22 when the tray 12 is stowed within the recess 24 of the frame 14. The tray 12 has a hollow construction that includes a pair of panels 40, between which a slot 42 is formed. An extension 44 of the tray 12 is slidably received in the slot 42, so that the extension 44 can be slid out when needed, and stowed when not needed or when the tray 12 is stowed within the frame 14. Consequently, the extension 44 does not occupy any additional room or wall space when the tray 12 is stowed.

From FIGS. 1 through 3, it can be seen that the tray 12 and its extension 44 provide ample surface area that is uncluttered by the mechanical components of the tray 12. For use in commercial settings such as hotels, motels, airplanes and buses, the top and bottom panels 40 of the tray 12 and the upper casing 18 of the frame 14 are preferably equipped with recessed graphic areas 48 in which advertising can be contained. Advertisements can also be placed in the recess 24 of the mounting frame 14. Clear protective panels 50, such as thin polycarbonate panels, are secured to the tray 12 and mounting frame 14 by inserting the edges of the panels 50 into undercuts 52 in the panels 40 and casing 18. In this manner, advertising can be viewed at all times from the casing 18, from one of the panels 40 of the tray 12 depending on whether the tray 12 is deployed or stowed, and from within the recess 24 of the mounting frame 14 when the tray 12 is deployed.

Figure 4:
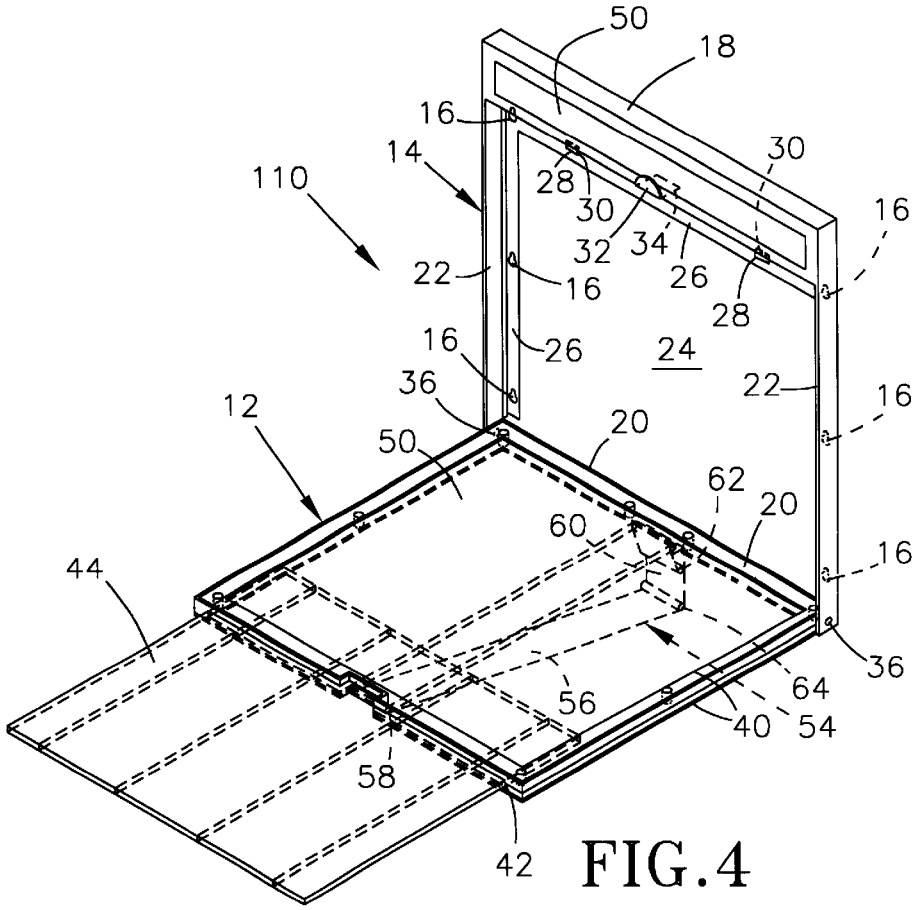
FIG. 4 is a perspective view of a reading tray and mounting frame assembly in accordance with a second embodiment of this invention.
Figure 5:
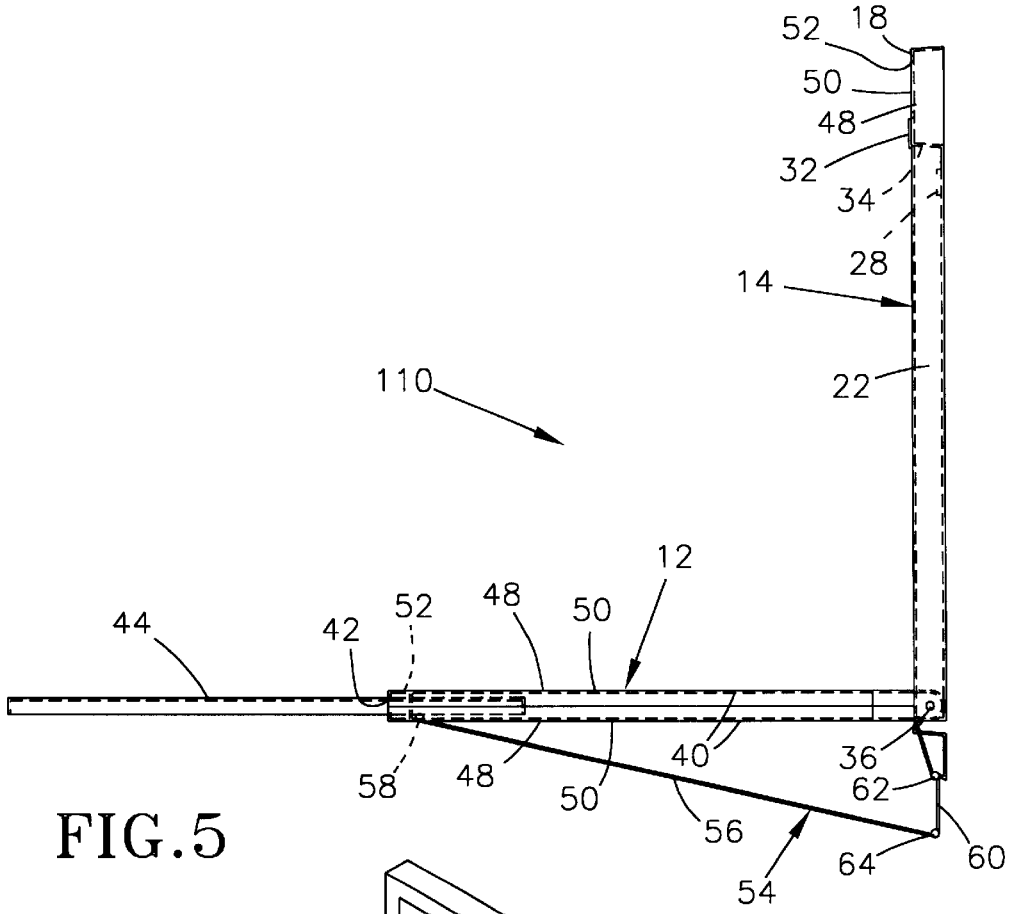
FIG. 5 is a side view of the assembly of FIG. 4.
Figure 6:
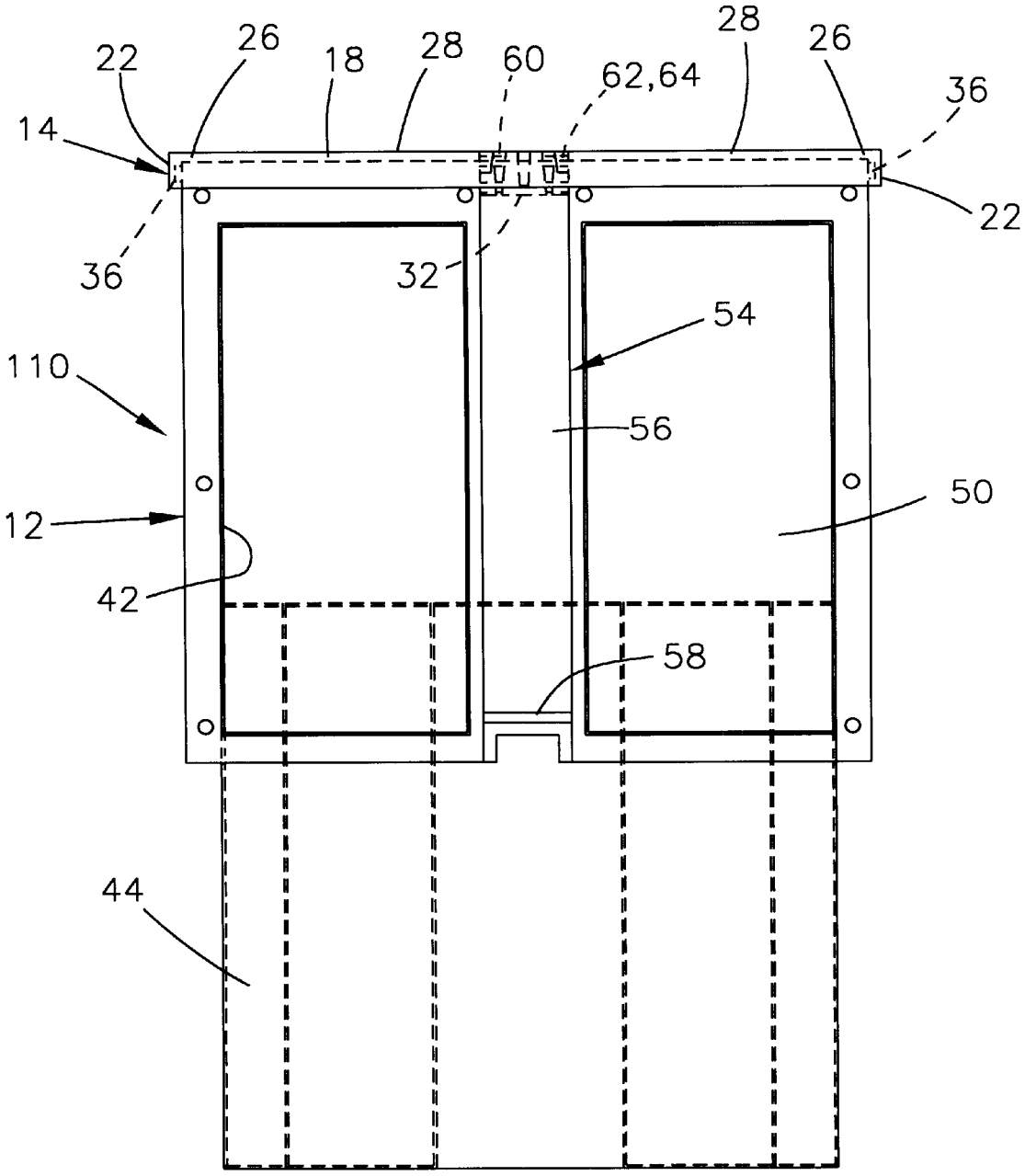
FIG. 6 is a top view of the assembly of FIG. 4.

In the embodiment of FIGS. 4 though 6, an assembly 110 very similar to that of FIGS. 1 through 3 is shown, as indicated by the consistent use of reference numbers for identical or equivalent features of the assemblies 10 and 110. However, the assembly 110 of FIGS. 4 through 6 is modified to substitute a single support bracket 54 for the pair of brackets 38 of the first embodiment. The support bracket 54 is attached to the lower rail 20 of the mounting frame 14, and is configured to support the tray 12 from beneath so as not to interfere with the use of the tray 12 or occupy a significant amount of space below the tray 12. The bracket 54 is also configured to fold up flush and tight with the tray 12 in the frame 14, and therefore does not significantly add to the room and wall space occupied by the tray 12 either when deployed or stowed.

As shown, the bracket 54 has a support arm 56 attached to the tray by a first fixed pivot 58, and a pivot arm 60 attached to the lower rail 20 of the frame 14 by a second fixed pivot 62. The support and pivot arms 56 and 60 are connected together with a hinge 64. When the tray 12 is stowed, the hinge 64 nests within the lower rail 20, and when the tray 12 is deployed, the hinge 64 abuts the mounting wall (not shown) so that the support arm 56 is able to solidly support the tray 12. Other than the modifications necessary to accommodate the support bracket 54, the assembly 110 of FIGS. 4 through 6 can be identical to the embodiment of FIGS. 1 through 3.

Figure 7:
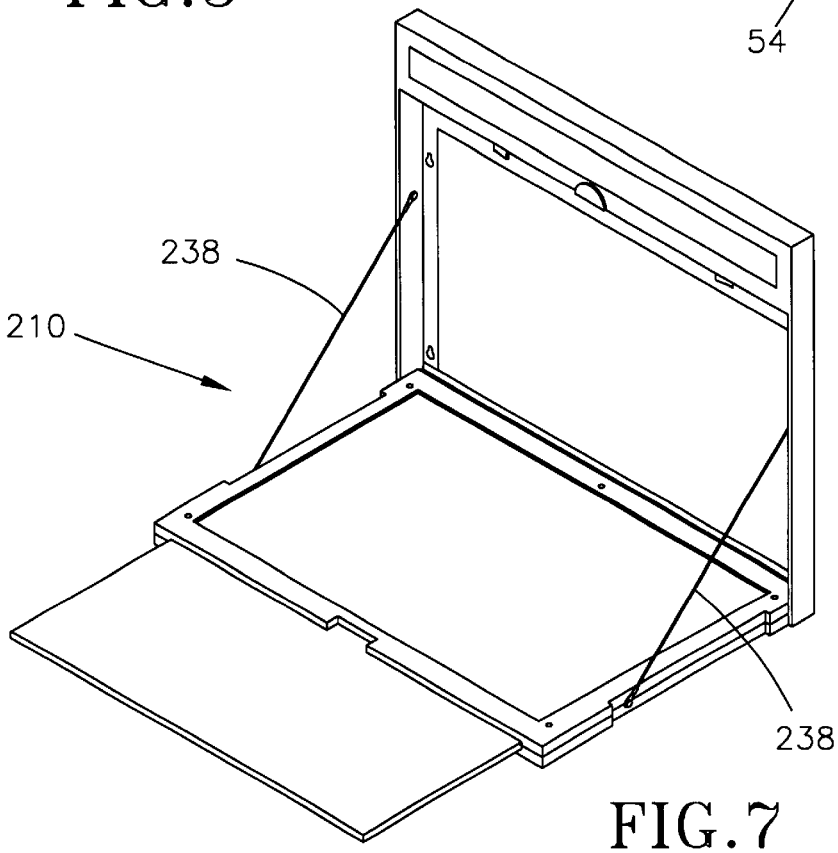
FIG. 7 is a perspective view of a reading tray and mounting frame assembly in accordance with a preferred embodiment of this invention.

In the embodiment of FIG. 7, a wall-mounted stowable reading tray assembly 210 essentially identical to that of FIGS. 1 through 3 is shown. The assembly 210 of FIG. 7 differs by employing flexible cords 238 in place of the brackets 38 of the first embodiment. The cords 238 can be formed of any suitable material, including twisted or braided metal or plastic strands.

While the invention has been described in terms of specific embodiments, it is apparent that other forms could be adopted by one skilled in the art. For example, the wall-mounted stowable reading trays could differ in appearance and construction from the embodiments shown in the Figures, and appropriate materials could be substituted for those noted. Accordingly, the scope of the invention is to be limited only by the following claims.

What is claimed is:

1. A legless wall-mountable reading tray assembly for placement in a confined space, the reading tray assembly comprising:

a mounting frame having means for attaching the mounting frame to a vertical surface;

a recess in the mounting frame;

a tray member pivotably attached to the mounting frame near an edge thereof, the tray member being pivotably attached for stowing within the recess of the mounting frame and for cantilevered deployment from the mounting frame;

means for supporting the tray member when deployed from the mounting frame; and an extension slidably mounted to the tray member for stowing completely within the tray member and deployed by sliding out of the tray member so as to be cantilevered from the mounting frame.

2. A legless wall-mountable reading tray assembly according to claim 1, wherein the supporting means comprises cords attached to the mounting frame and the tray member.

3. A legless wall-mountable reading tray assembly according to claim 2, wherein the cords are completely stowable within the recess of the mounting frame with the tray member.

4. A legless wall-mountable reading tray assembly according to claim 1, wherein the supporting means comprises folding brackets attached to the mounting frame and the tray member, the folding brackets supporting the tray member from a location on the mounting frame away from the edge to which the tray member is pivotably attached to the mounting frame.

5. A legless wall-mountable reading tray assembly according to claim 4, wherein the folding brackets are completely stowable within the recess of the mounting frame with the tray member.

6. A legless wall-mountable reading tray assembly according to claim 1, wherein the supporting means comprises a single bracket that supports the tray member from beneath.

7. A legless wall-mountable reading tray assembly according to claim 6, wherein the bracket comprises two bracket members pivotably connected to each other, the bracket folding up flush against the tray member and the edge of the mounting frame when the tray member is stowed within the recess of the mounting frame.

8. A legless wall-mountable reading tray assembly according to claim 1, further comprising a latch for locking the tray member within the recess of the mounting frame.

9. A legless wall-mountable reading tray assembly according to claim 8, wherein the latch is a portion of the mounting tray contiguous with the recess.

10. A legless wall-mountable reading tray assembly according to claim 8, wherein the latch is substantially flush with a surface of the mounting frame.

11. A legless wall-mountable reading tray assembly according to claim 1, further comprising a compartment in which an advertisement can be contained.

12. A legless wall-mountable reading tray assembly according to claim 11, wherein the compartment is visible from a surface of the tray member that is visible when the tray member is stowed.

13. A legless wall-mountable reading tray assembly according to claim 11, wherein the compartment is visible from a surface of the tray member that is visible only when the tray member is deployed.

14. A legless wall-mountable reading tray assembly according to claim 11, wherein the compartment is defined by at least one of a surface of the tray member and a portion of the mounting frame located outside the recess of the mounting frame, so that the compartment is visible when the tray member is stowed within the recess.

15. A legless wall-mountable reading tray assembly according to claim 11, wherein the compartment is defined by at least one of a surface of the tray member and a portion of the mounting frame located within the recess of the mounting frame so that the compartment is visible only when the tray member is deployed from the recess.

16. A legless wall-mountable reading tray assembly according to claim 11, wherein the tray member comprises two compartments defined by transparent panels on oppositely-disposed surfaces of the tray member, the transparent panels defining slots into which advertisements can be installed and removed.

17. A legless wall-mountable reading tray assembly according to claim 1, further comprising means for biasing the tray member away from the mounting frame when the tray member is stowed in the recess of the mounting frame.

18. A legless wall-mountable reading tray assembly according to claim 1, wherein the reading tray assembly is mounted to an interior room wall of a structure chosen from the group consisting of hotels, motels, airplanes and buses.

19. A legless wall-mountable reading tray assembly for placement in a confined space, the reading tray assembly comprising:

a mounting frame having oppositely-disposed first and second surfaces and oppositely-disposed first and second edges;

means associated with the first surface of the mounting frame for attaching the mounting frame to a vertical surface;

a recess in the second surface of the mounting frame;

a tray member pivotably attached to the mounting frame near the first edge thereof, the tray member being pivotably attached for stowing within the recess of the mounting frame and for cantilevered deployment approximately perpendicular to the mounting frame, the tray member having oppositely-disposed first and second surfaces, the first surface of the tray member being concealed within the recess when the tray member is stowed and visible when the tray member is deployed;

means attached to the mounting member for supporting the tray member when deployed cantilevered from the mounting frame;

an extension slidably mounted within the tray member for stowing completely within the tray member and for deployment by sliding out of the tray member so as to be cantilevered from the mounting frame;

a latch for locking the tray member within the recess of the mounting frame;

at least first, second and third compartments defined by transparent panels of the mounting frame and the tray member, the first compartment being visible from the first surface of the tray member when the tray member is deployed, the second compartment being visible from the second surface of the tray member when the tray member is stowed, and the third compartment being visible within the recess of the mounting frame when the tray member is deployed; and means for biasing the tray member away from the mounting frame when the tray member is stowed in the recess of the mounting frame.

20. A legless wall-mountable reading tray assembly according to claim 19, wherein the reading tray assembly is mounted to an interior bathroom wall of a structure chosen from the group consisting of hotels, motels, airplanes and buses.

* * * * *

UNITED STATES PATENT AND TRADEMARK OFFICE

CERTIFICATE OF CORRECTION

PATENT NO. : 6,308,641 B1
DATED : October 30, 2001
INVENTOR(S) : Brian F. Kingsbury It is certified that error appears in the above-identified patent and that said Letters Patent is hereby corrected as shown below:

Title page,
Items [12] and [76]; the inventor's name should read -- Brian F. Kingsbury -- instead of "Brian F. Kingbury".

Signed and Sealed this

Twenty-eighth Day of May, 2002

*Attest:*

*Attesting Officer*

JAMES E. ROGAN
*Director of the United States Patent and Trademark Office*